US007171792B2

(12) United States Patent
Windahl et al.

(10) Patent No.: US 7,171,792 B2
(45) Date of Patent: Feb. 6, 2007

(54) PIPE AND CABLE TRUSS SYSTEM

(75) Inventors: Ethan L. Windahl, 1511 Elcadore Cir., #34, Anchorage, AK (US) 99503; Barry W. Santana, Somers, MT (US)

(73) Assignee: Ethan L. Windahl, Anchorage, AK (US)

( * ) Notice: Subject to any disclaimer, the term of this patent is extended or adjusted under 35 U.S.C. 154(b) by 391 days.

(21) Appl. No.: 10/829,893

(22) Filed: Apr. 22, 2004

(65) Prior Publication Data

US 2005/0247006 A1 Nov. 10, 2005

(51) Int. Cl.
*E04C 3/02* (2006.01)

(52) U.S. Cl. ..... 52/690; 52/633; 52/691; 52/693

(58) Field of Classification Search ..... 52/690, 52/633, 647, 691, 693, 63, DIG. 9, 123, 639–641; 135/115, 158, 122, 906, 908
See application file for complete search history.

(56) References Cited

U.S. PATENT DOCUMENTS 5,218,801 A 6/1993 Hereford

*Primary Examiner*—Naoko Slack
*Assistant Examiner*—Jonathan Junker
(74) *Attorney, Agent, or Firm*—Dorsey & Whitney LLP

(57) ABSTRACT

The present invention is a truss system constructed of rigid members and cables. In a preferred embodiment, the rigid members are used drill piping. Two inclined upper members are joined together at an angle to form a truss peak junction. A vertical member connects to and supports the lower end of each inclined upper member. The bottom of each vertical member sits in a collar attached to the top of a foundation member located in the ground. A tensioning member is perpendicularly attached to each inclined upper member near the midpoint of the inclined member. For each inclined upper member, a cable attaches to the inclined upper member near the truss peak, runs through a penetration in the tensioning member, and attaches to the lower end of the inclined member. Finally, a cable with first and second ends has its first and second ends secured so as to apply tension that opposes spreading of the lower ends of the inclined upper members.

22 Claims, 7 Drawing Sheets

PIPE AND CABLE TRUSS SYSTEM

BACKGROUND OF THE INVENTION

The present invention relates generally to trusses for buildings, and more specifically to methods and apparatus for a new truss system primarily constructed out of pipe and cable.

FIELD OF THE INVENTION

In Alaska, and other areas with severe winter conditions, there is a need for enclosed arenas or similar buildings that can be used year-round for storage, sports, horse training or other activities involving large open areas. Unfortunately, utilizing traditional construction methods for an enclosed structure makes the building relatively expensive. Recognizing the need for an inexpensive alternative to traditional construction techniques and being aware of supplies of used and/or surplus drill pipe from the oil fields of Alaska's North Slope, the present inventor previously designed and built an enclosed circular arena utilizing trusses made from used drill pipe and cable.

In this circular building, 14 half trusses radiate from a center post with upper and lower segments. Each half-truss was in the form of a short-stemmed "T" made from one long piece of pipe with a shorter tensioning member projecting at a right angle from the center of the long piece of pipe. A tensioning cable ran from one end of the long piece of pipe, passing through the projecting end of the tensioning member to the other end of the long piece of pipe. Thus, the tensioning cable forms a very wide "V", its lower point coinciding with the projecting end of the tensioning member that forms the short stem of the "T". The lower end of each half truss is supported on a wall post of pipe and is affixed to the wall post top. The wall posts are placed in a circle around the center post to define the circular building's outer wall.

The upper segment of the circular building's center post has an upper hub and a lower hub which serve as the junctions for all of the half-truss piping and for lower cables running from the wall posts to the center, respectively. The lower segment of the center post is utilized to support the structure during construction and can be removed once the building is completed. Although this new construction approach offered lower labor, equipment, and material costs as compared to more traditional construction methods, it still had some significant limitations. First, the radial truss system did not lend itself to rectangular building construction. Secondly, the radial truss system was still quite labor and equipment intensive. The initial step in constructing a structure utilizing the radial truss system was to completely install as upright members the center post with its two hubs. Each half truss was then separately constructed with a wall post extending downwardly. This unit was individually raised up with the wall post at its foundation point, braced or held in place, and joined to its respective center post connection point. The lower cables were then installed between the wall posts and the lower hub of the center post. Thirdly, the lower piece of the center post had to be removed to completely open the enclosed area. This system required a crane/lift, scaffolding and significant time. Finally, the resulting circular building could not normally have an entrance/exit wider than the spacing of two adjacent wall posts supporting two adjacent radial trusses. This restricts access by larger equipment or objects.

Thus, there is a need for an improved design for a pipe and cable truss system and buildings constructed using such system. If natural gas reserves are developed on the North Slope of Alaska and a gas pipeline is constructed, there will be a large demand for rectangular warehouse-type buildings for storage of supplies and equipment for maintenance shops and general use. The present invention is advantageous in that it will allow an inexpensive and easy way to construct rectangular storage buildings while recycling used drill pipe and cable.

BRIEF SUMMARY OF THE INVENTION

The invention is a truss system comprised of rigid longitudinal members and cable. In a preferred embodiment, the longitudinal members will be used drill pipe and cable. However, it will be apparent to those skilled in the art that the rigid members could also be any type of common structural material of generally similar strength characteristics including, for example, structural steel channels, angles, or wide flanges, wooden or glue-laminate beams, etc. Additionally, it is also apparent to those skilled in the art that the materials need not be used, but could be new.

The present invention addresses the aforementioned disadvantages of the prior art. First, one embodiment of the present invention allows a pair of opposed wall posts and each completed roof truss extending between the wall posts (pipe, cables and connections) to be constructed on the ground and then erected in one piece as roof-wall truss, thereby saving time and labor and significantly decreasing the need for cranes/lifts, bracing and scaffolding. Second, the present invention does not require for construction the radial half-truss system's center post and its accompanying pipe and cable hubs, thereby further simplifying construction. Third, the present invention is applicable to rectangular buildings. This is advantageous, because rectangular buildings usually lend themselves much more readily to storage than a circular structure. Lastly, the building entrance/exit can be almost as wide as the full span of the trusses used.

In one embodiment, a roof truss is formed using two of the short-stemmed "T" half trusses described above. The two long pipe pieces (each with a tensioning member holding a tensioning cable in a wide "V") are joined at a peak in a wider inverted "V" to form the first and second upper members of a full roof truss. The upper ends of each of the first and second upper members of a truss thus converge, and these upper ends are secured at an angle, forming a truss peak. The upper members form the ribs upon which a roof can be built. In a building, the first and second upper members of a full roof-truss are supported above ground level by first and second vertical or wall members, each of which supports the lower end of one of the first and second upper members. The roof truss is formed and then first and second vertical members are erected in a pair, spaced apart to define building walls and to support the roof truss. The roof truss may be placed on and joined to the pair of vertical members. The top of the first vertical member is secured to the lower end of the first upper member. Likewise, the top of the second vertical member is secured to the lower end of the second upper member. The location of the connections between the respective upper and vertical members depends on the amount of roof overhang/eave desired (including no overhang at all). The bottom ends of the vertical members rest within the collars of foundation elements installed in the ground. The vertical members form a rib structure upon which walls can be built.

Each of the first and second upper members is strengthened by its respective projecting tensioning member and associated cable. Each tensioning member is secured perpendicularly to and projects from its respective upper member at a location approximately midway between the truss peak and the junction between the upper member and its supporting vertical member. Each tensioning member may be braced by two opposed support members which may be diagonal struts or gussets running diagonally from approximately the midpoint of the tensioning member to the upper member. A first cable connects to one end of the first upper member near the truss peak, runs through a cable receiver, such as a guide opening in the projecting end of the first tensioning member, and connects to the other end of the first upper member near the junction of the first upper member and its supporting vertical member. Similarly, a second cable connects to one end of the second upper member near the truss peak, runs through a guide opening in the projecting end of the second tensioning member and connects to the other end of the second upper member near the junction of the second upper member and its supporting second vertical member. Finally, a third horizontal cable runs from one connection point near the top of the first vertical member to a second connection point near the top of the second vertical member.

In another embodiment, the roof truss is built to include first and second vertical or wall posts or members, one attached to each of the first and second upper members. Thus, a roof-wall truss can be assembled on the ground and both roof structure and wall structure can be raised at the same time. In this embodiment the third, horizontal cable can be connected either between the pair of vertical or wall posts or between the lower ends of the first and second upper members.

An advantage of this roof-wall truss system over the present inventor's previous radial pipe and cable truss system is that the elements of the truss and its vertical posts can be joined together on the ground, erected in one complete piece, and attached to the appropriate foundation elements. Thus, wall and roof structure are erected all at once.

An advantage of the present invention is a decrease in the amount of labor and equipment necessary to construct a structure utilizing a pipe and cable truss system, as compared to the previous radial pipe and cable truss system.

Another advantage of the present invention is a reduction in the complexity of the pipe and cable truss system as compared to the previous radial pipe and truss system with its accompanying cable and pipe hubs and center post.

Still another advantage of the present invention is to allow the utilization of a pipe and cable truss system in a rectangular building structure.

DETAILED DESCRIPTION OF THE INVENTION

A. Basic Peaked Roof Truss System

Figure 1:
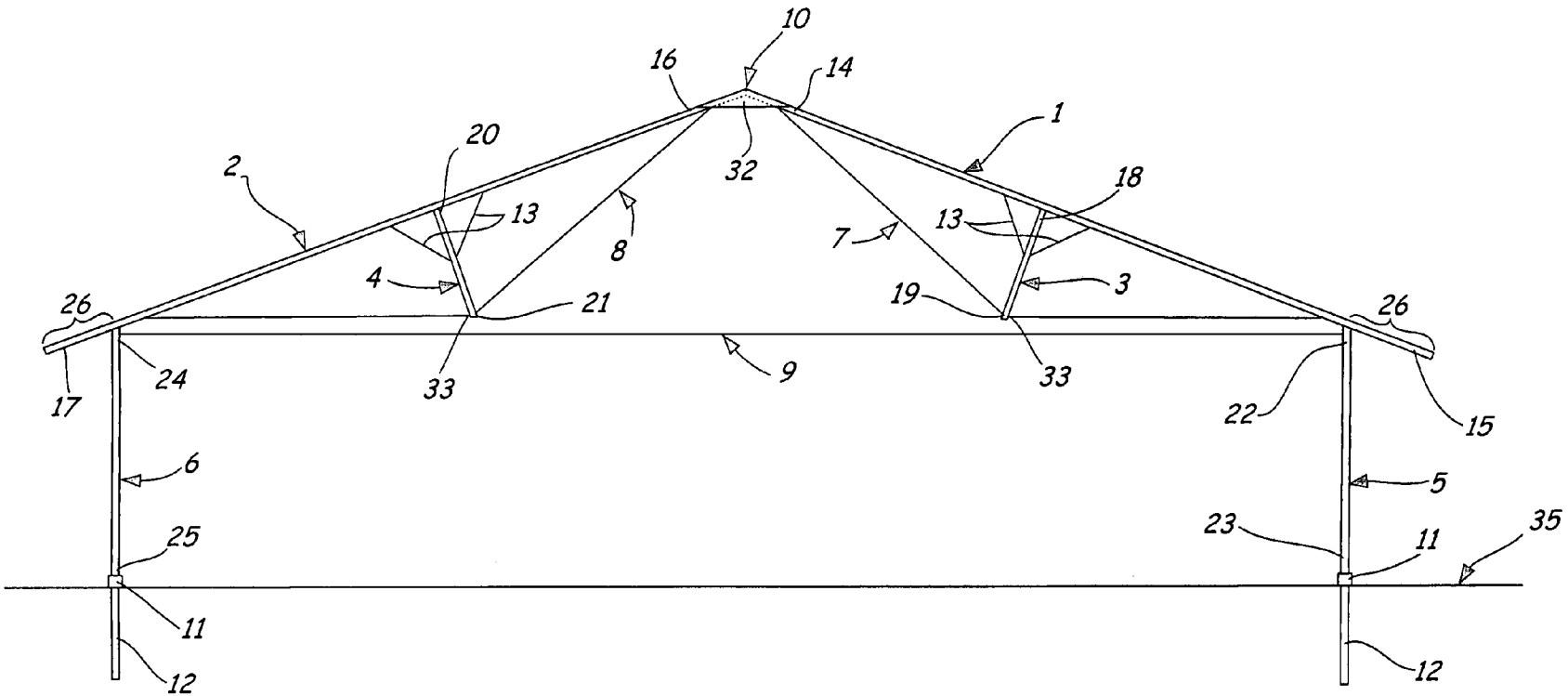
FIG. 1 is an elevation view of a building frame utilizing the assembled truss.

FIG. 1 shows an elevation view of a building utilizing an assembled roof truss system. In general, each roof truss system consists of two short-stemmed "T"'s formed of pipe with their upper longitudinal members 1, 2 joined at one end to form a wide, inverted "V". The ends of the upper member of each "T" are linked by a tensioning cable 7, 8 that passes through the distal end of the short stem of each "T". Thus, the cable of each "T" forms a wide, non-inverted "V" and the two cables 7, 8 together generally form a "W", which spans from side wall to side wall of a structure built with multiple, parallel trusses supporting the roof.

Figures 8, 9:
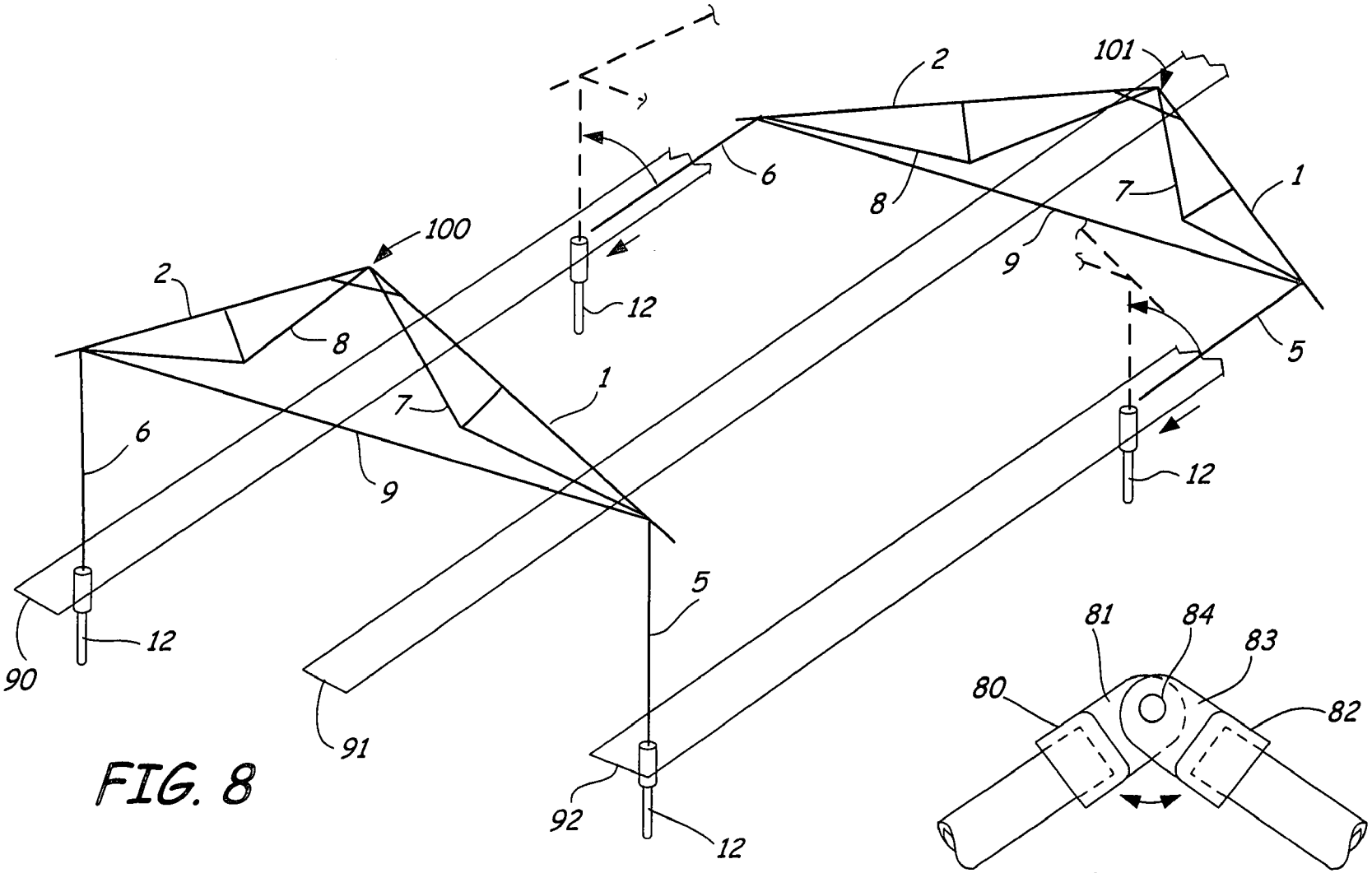
FIG. 8 is a pictorial, schematic view showing assembly and erection methods associated with the truss and building frame of the present invention.
FIG. 9 is an elevation showing a flexing or adjustable joint used with the embodiment of FIGS. 1–5.

The first longitudinal upper member 1 and the second longitudinal upper member 2 form the upper part of the full truss of FIG. 1 and serve as ribs upon which the roofing material may be placed. The first upper member 1 has a first (upper) end 14 and a second (lower) end 15. The second upper member 2 has a first (upper) end 16 and second (lower) end 17. The first upper member's first end 14 and the second upper member's first end 16 converge at an angle to form the wide, inverted "V" and are secured to each other at a peak connector 10, thereby forming the truss peak junction. The peak connector 10 or means of securing these upper members together to form the truss peak junction may include, but is not limited to, welding, the use of braces or gusset plates, brackets, flanges, threads, bolts, clamps, custom receiver clamps and other mechanical means. Although in one embodiment this connection is rigid and fixes the angle between the first and second upper members 1, 2 of a truss system, there may be applications where the apex or peak connector is best formed as a flexing or adjustable joint, permitting adjustment in the peak angle. As shown in FIG. 9, such a joint may be formed with a pair of pipe end caps 80, 82, each with a corresponding eyelet plate 81, 83. The eyelet plates 81, 83 are joined by a bolt 84 or similar fastener that permits relative rotation of the eyelet plates as shown in FIG. 9.

It should be noted that these various securing means are also applicable to other connections between the various elements of the truss system disclosed in this specification. Consequently, throughout this specification whenever two or more elements of the present invention are stated to be secured/connected together, the methods for securing these elements together shall be considered to be any of the aforementioned securing means. In one embodiment, as reflected in FIG. 3, the truss peak connector 10 is formed by securing the first upper member 1 to the second upper member 2 with a gusset pair, a triangular piece of flat metal stock 32 welded or bolted to each side of the truss peak. It will be understood that peak connector 10 will need to be selected to withstand the stress of a least two modes: (1) roof load stresses once the truss system is in place; and (2) erection stress arising when a truss is rotated and/or lifted from its generally flat assembly position to a position in a roof or roof-wall system.

Figure 2:
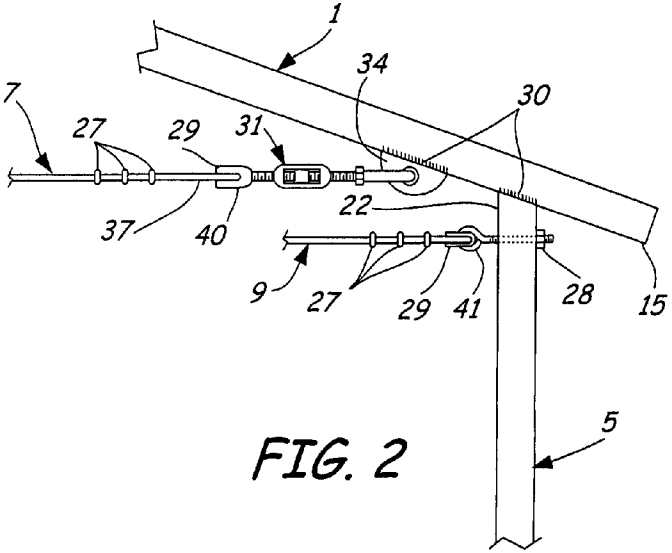
FIG. 2 is an enlarged view of the right end of the truss shown in FIG. 1 and its connection to a vertical wall member.

Referring again to FIG. 1, it can be seen that when the roof truss system is used in a building, the first upper member 1 and the second upper member 2 are supported above ground level 35 by the first vertical member 5 and the second vertical member 6, respectively. These vertical members form the basic frame upon which walls can be built. The first vertical member 5 has a top end 22 and a bottom end 23. Likewise, the second vertical member 6 has a top end 24 and a bottom end 25. The first vertical member's top end 22 is secured to the first upper member 1 at a wall junction located on the upper member 1 adjacent to the first upper member's second end 15. Similarly, the second vertical member's top end 24 is secured to the second upper member 2 at a wall junction located on the upper member 2 adjacent to the second upper member's second end 17. The exact location of either wall junction will depend on the amount of roof overhang/eave 26 desired. In some applications, no overhang is provided, to permit the building to be covered easily with fabric or other flexible skin. In one embodiment, as shown in FIG. 2, these junctions between the upper members 1, 2 and the vertical members 5, 6 may be made by welding. In another embodiment a clamp or forked end cap (not shown) that fits on and can be tightened onto a vertical member top end and grips opposed sides of an upper member 1, 2 may be used. As FIG. 1 indicates, each of the first vertical member's bottom end 23 and the second vertical member's bottom end 25 rests within a collar 11 which may be mounted on top of a foundation element 12 inserted sufficiently deeply into the ground. (It should be noted that girts and purlins may also be used as required to support wall cladding between vertical members or to provide roof support between rafter end points, but these are for simplicity not shown in any drawing.)

In one embodiment, the first and second vertical members 5, 6 and the foundation elements 12 are 2⅞" O.D. drill pipe or hard connection drill pipe. The collars 11 are 3" I.D. pipes and are threaded and/or welded onto the top of each foundation element 12. The first and second vertical members 5, 6 rest within the collars 11. If a heavier but stronger 3" I.D. pipe were to be used for vertical members, the foundation element 12 (pipe) would be driven into the ground with an interior section of 2⅞" O.D. welded to it. Then the 3" I.D. pipe used for vertical members would drop over the outside of the 2⅞" O.D. section and hold in place until welded securely.

FIG. 1 also shows that the first upper member 1 and the second upper member 2 are strengthened by a first tensioning member 3 and a second tensioning member 4, respectively, each of which has an associated tensioning cable, 7 and 8. The first tensioning member's first end 18 is perpendicularly and rigidly secured to the first upper member 1 at a first junction located on the upper member 1 approximately midway between the upper member's connection with the first vertical member's top 22 and the truss peak 10. The first tensioning member projects generally downward to a distal end. Likewise, the second tensioning member's first end 20 is perpendicularly and rigidly secured to the second upper member 2 at a second junction located on the upper member 2 approximately midway between the upper member's connection with the second vertical member's top 24 and the truss peak connector 10. The second tensioning member projects generally downward to a distal end. (It should be noted that in an alternative version of the disclosed truss discussed in connection with FIG. 7, multiple tensioning members may be secured to each upper member to further strengthen each upper member by decreasing its effective length.) The first tensioning member 3 and the second tensioning member 4 are each braced by two opposed support members 13, which may be diagonal struts or, in another embodiment, triangular gussets or the like that run from the upper members 1, 2 to each side of corresponding tensioning members 3, 4.

FIG. 1 shows the routing of the first tensioning cable 7 and the second tensioning cable 8. The second cable 8 runs from its one connection to the second upper member 2, near the truss peak connector 10, through a cable receiver, such as guide opening 33 piercing the second tensioning member's distal or projecting end 21, to the cable's other connection to the second upper member 2, near the connection of the second upper member 2 to the second vertical member 6. Similarly, the first tensioning cable 7 runs from its one connection to the first upper member 1, near the truss peak connector 10, through a cable receiver, such as cable guide opening 33 (FIG. 4) piercing the first tensioning member's distal end 19, to the cable's other connection to the first upper member 1 near the connection of the first upper member 1 to the first vertical member 5. Each cable 7, 8 includes at least one turnbuckle that permits cable tension to be adjusted. Normally the tension would be adjusted to induce a slight upward bowing of each of the first and second upper members 1, 2, when they are in installed position.

Figure 3:
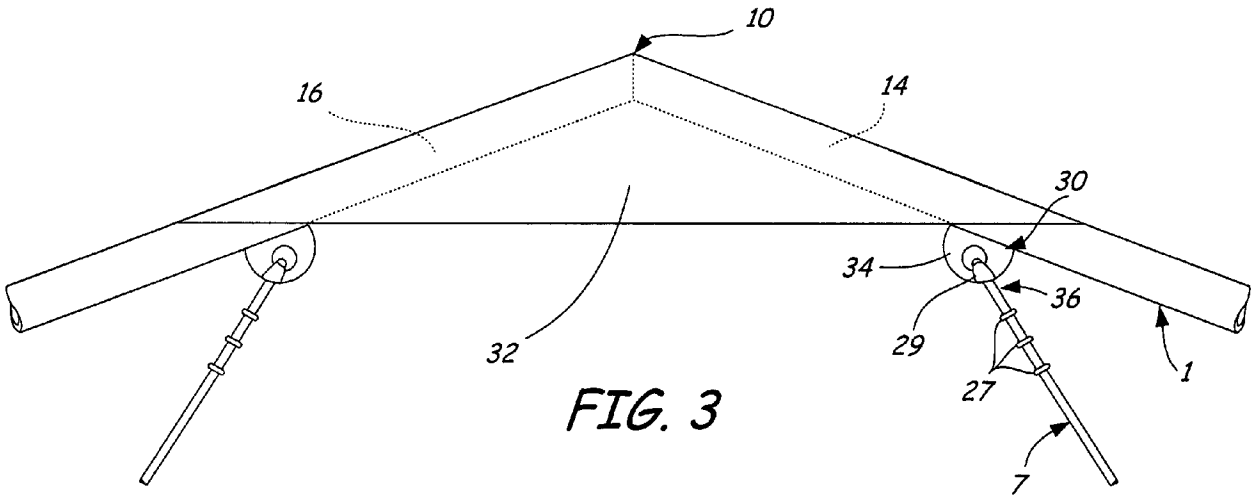
FIG. 3 is an enlarged view of the truss peak.

FIG. 3 shows an enlarged view of one embodiment for the connection between the first cable 7 and the first upper member 1 near the truss peak connector 10. FIG. 3 is also representative of the corresponding connection between the second cable 8 and the second upper member 2. In this embodiment, the first cable's first end 36 is looped through an eyelet 34 that is secured by a weld 30 to the first upper member 1 near the truss peak connector 10. The first cable's first end 36 is looped back and secured to the first cable 7 by several cable clamps 27, thereby forming a cable loop through the eyelet 34. The ensuing cable loop through the eyelet 34 rests in a thimble 29.

Figure 4:
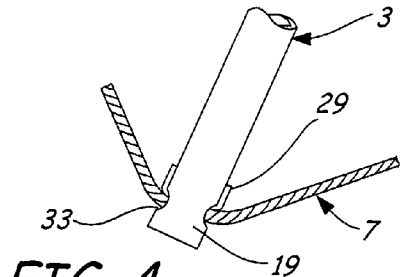
FIG. 4 is an enlarged view of a cable penetration through a tensioning member.

FIG. 4 shows an enlarged view of one embodiment for the cable guide opening 33 through the first tensioning member's distal end 19. FIG. 4 is also representative of the corresponding guide opening in the second tensioning member's distal end 21. In this embodiment, the first cable 7 passes through the first tensioning member's distal end 19 through a cable guide opening 33. The first cable 7 rests in a thimble 29 located in the cable penetration 33 that permits the cable 7 to slide in the opening 33 with minimal wear.

FIG. 2 shows an enlarged view of one embodiment for the connection between the first cable 7 and the first upper member 1 near the connection between the first upper member 1 and the first vertical member 5. FIG. 2 is also representative of the corresponding connection between the second cable 8 and the second upper member 2. In this embodiment, the first cable's second end 37 is looped through a turnbuckle eyelet 40. The first cable's second end 37 is looped back and secured to the first cable 7 by several cable clamps 27, thereby forming a cable loop through the turnbuckle eyelet 40. The resulting cable loop through the turnbuckle eyelet 40 rests in a thimble 29. The other end of the turnbuckle 31 is connected to an eyelet 34 that is secured by a weld 30 to the first upper member 1 near the connection between the first upper member 1 and the first vertical member 5. The turnbuckle 31 can be used to increase or decrease the tension in the first cable 7. This permits the first upper member to be pre-loaded to resist anticipated or existing roof loads.

Referring once again to FIG. 1, it can be seen that the third (horizontal) cable 9 runs from its connection on one end with the first vertical member 5 to its connection on the other end with the opposed, second vertical member 6. FIG. 2 shows an enlarged view of an embodiment for the connection between the third cable 9 and the first vertical member 5 near the connection between the first upper member 1 and the first vertical member 5. FIG. 2 is also representative of the corresponding connection between the third cable 9 and the second vertical member 6. In the embodiment shown, the third cable 9 is looped through the eyebolt eyelet 41. The end of the third cable is looped back and secured to the third cable 9 by several cable clamps 27, thereby forming a cable loop through the eyebolt eyelet 41. The ensuing cable loop through the eyebolt eyelet 41 rests in a thimble 29. The eyebolt 28 penetrates or is otherwise connected to the first vertical member 5 near the top end of the first vertical member 22. The eyebolt 28, if needed, may be held in place by a corresponding nut. With sufficiently long threading, this nut can be used to increase or decrease the amount of tension in the third cable 9. Otherwise, a turnbuckle as shown at 31 may be inserted at the cable end and used for tension adjustment.

An alternative placement of the third (horizontal) cable 9 is possible. Instead of connecting the cable 9 between vertical members 5 and 6, the cable 9 may be connected at points near the respective second or lower ends 15, 17 of upper members 1, 2. The connection points for cable 9 may be at, below or above the eyelets 34 at the lower end of either upper member 1, 2 and may be made at an eyelet and turnbuckle connection as at 34, 31. In this case the roof truss may become a separate component erectable independent of the vertical members 5, 6. As such, it could be lifted as a separate unit and connected to the upper ends of previously installed vertical members 5, 6. However, this cable placement is also consistent with the full roof-wall truss unit, including both vertical members 5, 6 and upper members 1, 2, that is built on the ground as one unit and lifted into foundation collars 11 as one unit.

The cable used for first, second and third cables 7, 8, 9 is preferably used downhole cable of suitable tensile strength. However, new or used steel or stainless steel cable of similar size (preferably about 7/16" O.D.) and suitable tensile-strength also would work.

B. Alternative Structures

The present truss structure can be built in a variety of sizes and is suitable for use in a variety of environments. Structural analysis has shown that for certain environments with building codes that anticipate heavy snow loads or high wind loads, certain enhancements of the structure shown above can be used that permit the construction of larger buildings and/or buildings that meet more stringent building codes. Several of these are described below.

1. Center Post Embodiment

Figure 5:
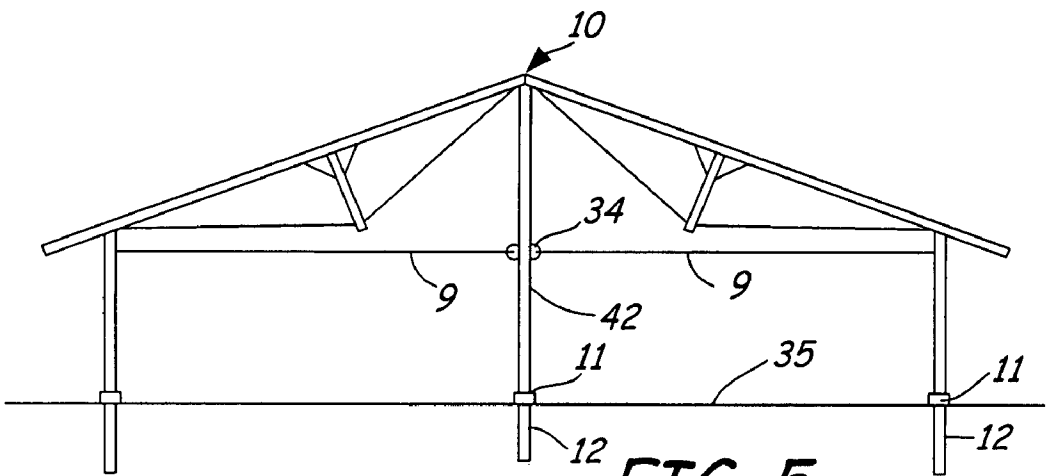
FIG. 5 is an end elevation view of a building frame utilizing the assembled truss with a center post.

FIG. 5 represents a truss and building embodiment that would be useful in conditions requiring additional roof load bearing capability, as in areas with high snow loads. This configuration would also be useful in building configurations where the wall-to-wall span between vertical member 5 and vertical member 6 is particularly large. In this embodiment, a one piece center post 42 provides additional support and may run from its connection at the truss peak connector 10 to its resting place in the collar 11 of a foundation element 12. As indicated in FIG. 5, the truss system may have two, joined cable segments forming third cable 9. Each segment of third cable 9 would run from its connection with a single vertical member 5, 6 to its connection to an eyelet 34 secured to the center post 42. Alternatively, the third cable 9 may simply penetrate center post 42 to allow the third cable 9 to run continuously and uninterruptedly between its connections to vertical members 5, 6 (this configuration of the third cable 9 is not shown in FIG. 5). Each truss peak connector 10 could be supported by a center post 42 or the center posts 42 could be used only at intervals, depending on expected loads and needs for clear areas without columns.

It should be noted that a full roof-wall truss unit including a center post also could be assembled on the ground and lifted as one unit such that vertical members' bottom ends are inserted into collars 11. Coordination with the additional collar for the center post would, of course, be needed. Assuming a roof-wall truss as in FIG. 1 or 5 can support its own weight, the center post 42 may be installed after the roof-wall truss is erected and before other roof loads are added. In addition, the center post 42 can be made removable. This may be useful where snow loads would make seasonal use of the center post desirable, but otherwise unnecessary. In this case a self jacking arrangement allowing the center post to be placed and then raised to take on load or lowered to release load may be employed.

2. Lean-to and Flat Roof Embodiments

Figure 6:
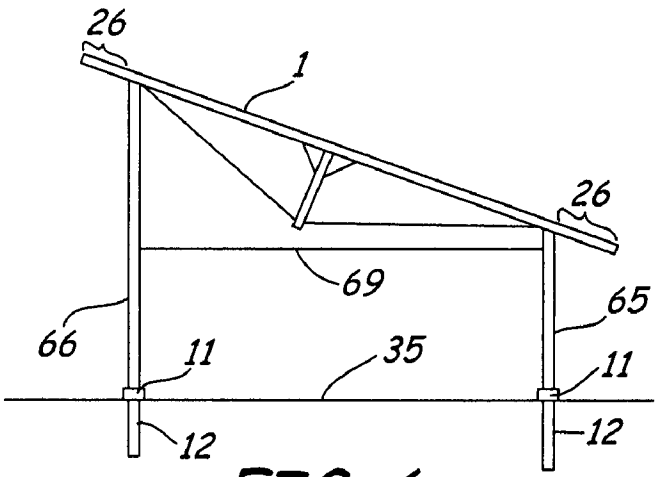
FIG. 6 is an end elevation view of a building frame utilizing half of the assembled truss in a lean-to type building.

In another embodiment, as shown in FIG. 6, half of the truss 1 disclosed in FIG. 1 could be used in the construction of a lean-to type shed. The primary difference between this embodiment and the one disclosed in FIG. 1 is that the half truss segment, with the second upper member 2, is deleted and vertical members 65, 66 of unequal length support the opposite ends of the upper member 1. In particular, the second vertical member 66 is now secured to the first upper member 1 at its peak. Third cable 69 extends horizontally between the vertical members 65, 66, but is connected nearer the midpoint of vertical member 66 than the top. This embodiment can utilize essentially the same securing means as utilized for the applicable elements disclosed in FIG. 1.

Figure 7:
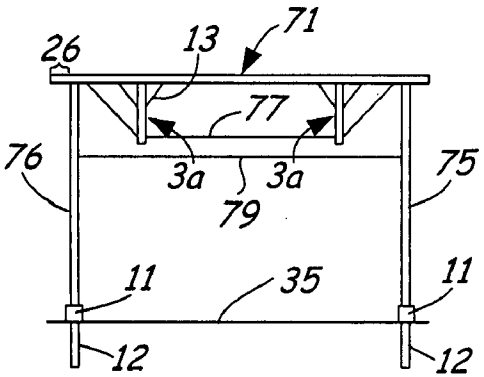
FIG. 7 is an end elevation view of a building frame utilizing a modification of the assembled truss in a flat roof configuration.

In a further embodiment, as shown in FIG. 7, both vertical members 75, 76 are again of the same height, and half of the truss disclosed in FIG. 1 could be installed in a horizontal configuration between the vertical members 75, 76 for structures requiring a flat roof. Third cable 79 extends horizontally between the vertical members 75, 76, but is connected well below the top of each vertical member 75, 76.

Thus, it is clear to one skilled in the art that the truss system disclosed is not limited only to peaked or sloped roof truss applications. Additionally, FIG. 7 illustrates the previously discussed concept that multiple tensioning members 3*a* can be secured to an upper member 1 to increase its bearing capacity by decreasing its effective length. This concept is equally applicable to both horizontal or sloped installations of the truss. Such additional tensioning members need not be equal in length as seen in FIG. 7. Rather, there may be one center tensioning member and a pair of shorter additional tensioning members placed symmetrically on either side of the center tensioning member. In this configuration, it may be useful to place clamps on the cable on either side of each tensioning member to help discourage cable movement.

It should be noted that a full roof-wall truss unit including either vertical members 65, 66 of unequal length (FIG. 6) or vertical members 75, 76 of equal length (FIG. 7) could be assembled on the ground and lifted as one unit into collars 11.

3. Strength Enhancements

Figure 10:
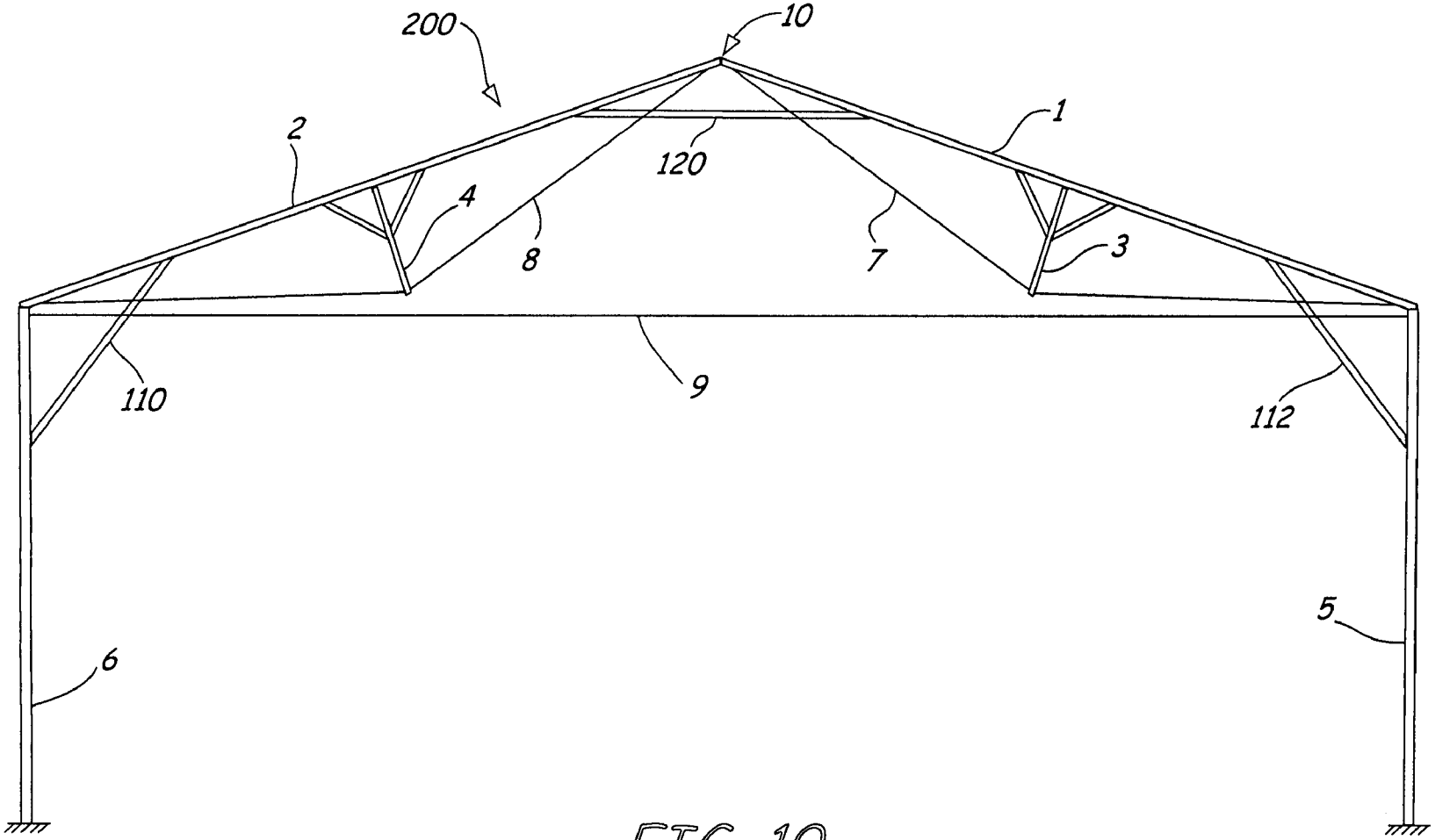
FIG. 10 is an elevation view of a building frame utilizing an alternative assembled truss, which includes diagonal bracing to improve strength.
Figure 11:
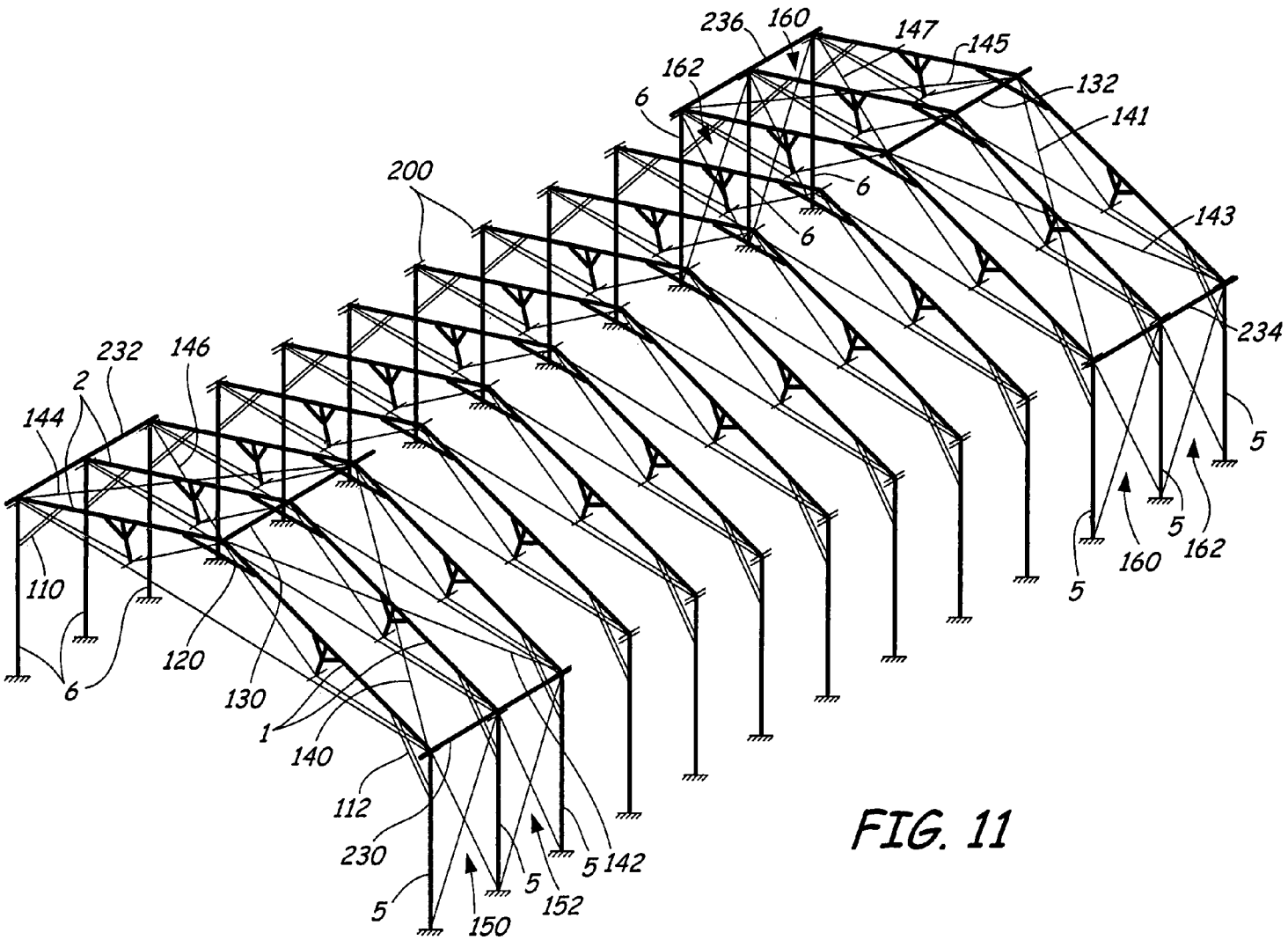
FIG. 11 is a pictorial view of the skeleton of a building using the building frame shown in FIG. 10 and showing not only the diagonal bracing but additional cabling used to improve strength.

Structural analysis shows that with the introduction of minimal additional bracing or cabling at certain points in the roof truss or roof-wall truss and between trusses and by using slightly heavier or reinforced materials, significant increases in building strength for a building with a rectangular footprint are possible. FIGS. 10 and 11 show schematic end and pictorial views (respectively) of the basic roof-wall truss of FIG. 1, enhanced with additional bracing. As best seen in FIG. 10, each full roof-wall truss 200, has a symmetrical pair of diagonal knee braces 110, 112, at the corners where vertical member 6 is joined to upper member 2 and where vertical member 5 is joined to upper member 1. Further bracing member 120 is connected between upper members 1 and 2 just below the peak connector 10 where members 1 and 2 are joined to form the truss peak junction (see FIG. 1). Each of the braces 110, 112, 120 may be formed of double angle steel members. Cable 9 becomes a double cable extending between vertical members 5. 6. Openings may need to be formed in braces 110, 112, 120 to accommodate cables 7, 8, 9. The braces 110, 112, 120 are welded, bolted or otherwise securely connected at the members between which they extend.

As best seen in FIG. 11, there are additional diagonal, crisscrossing pairs of tensioned cables 150, 152 used between the first and second and second and third vertical members 5 supporting the first, second and third roof trusses at the end of one wall. Although for simplicity not shown in FIG. 11, similar diagonal, crisscrossing pairs of tensioned cables are used between the vertical members 6 at the other ends of these first, second and third trusses, on the opposite side of the structure. The same reinforcing cables are used in symmetrical fashion at the opposite end of the building. Again, the cables are added between the first and second and between the second and third vertical members. As seen in FIG. 11, on both walls additional, symmetrically located, diagonal, crisscrossing pairs of tensioned cables 160, 162 are present, between vertical members 5 on one side and 6 on the other.

Further, at the roof peak on both ends of the building a further ridge brace 130, 132 is attached, preferably in the form of a continuous strut connecting truss peak junctions of the first (end wall), second and third trusses from the ends. Finally, extending downward from each end of brace 130 to a point near the top of each of the first and third vertical members 5, 6 at the opposed corners of the foreground end of the building are diagonal, crisscrossing pairs of tensioned cables 140, 142 and 144, 146. Similarly, at the opposite end of the building, extending downward from each end of ridge brace 132, are symmetrically placed, diagonal, crisscrossing pairs of tensioned cables 141, 143 and 145, 147.

Placed in parallel to the ridge brace 130 on opposed sides of the building skeleton structure shown in FIG. 11 are eave braces 230, 232 connected at two or more, preferably three, adjacent truss peak junctions. Similarly, in parallel to the ridge brace 132 on opposed sides of the other end of the building skeleton structure shown in FIG. 11 are continuous strut eave braces 234, 236. The eave braces 230, 232, 234, 236 are preferably continuous struts and located at or adjacent the top ends of adjacent vertical members 5, 6 or the lower ends of their corresponding upper members 1, 2. (Purlins and girts to support roofing and siding may be used but for simplicity are not shown in FIG. 1.)

The additional bracing and cabling does not have to be in the end bays, but wind loads originate there, so it is usually most beneficial to place it there. The braces 130, 132 are welded, bolted or otherwise securely connected to the truss peaks between which they extend. The ends of the various crisscrossing cables are anchored at eyelets (not shown) with connection details as described above for the other cables. The additional bracing and cabling is designed to be implemented primarily in the plane of the structural members it reinforces and to provide minimal reduction of the usable space within the building.

A structure using 2⅞" Grade L-80 tubing with a wall thickness of 0.217" for roof trusses, 4½" Grade L-80 tubing with a wall thickness of 0.271" for vertical members, 7/16" cable with a yield strength of 105,000 psi for all cabling, and double angle 2.5×2.5×¼" of A-36 steel for the knee bracing and ridge/eave bracing as shown in FIGS. 10, 11 permits buildings of significant size. The foundation may consist of concrete spread footings, pile-supported steel grade beams or 5" diameter Extra Strong pipe driven in the ground a minimum of 8 feet in warmer climates and slurried 15 feet in permafrost conditions. The double angle braces may be connected to the tubing with ⅝" diameter A-490 bolts through holes drilled in the tubes or bolted to plate gussets welded to the tubes. The steel gusset connection is advantageous, to avoid trying to drill holes accurately in the round, very hard tubing (holes for bolts cannot be flame-cut). The gussets could be easily welded to the columns and girders on the ground and holes drilled in the field.

Structural analysis shows that with materials as specified above and the additional bracing and cabling as shown in FIGS. 10, 11 the structures as shown in FIGS. 10, 11 can be of significant size and meet many codes. In particular for a building about 96 feet in length, the following spans and eave heights and loads are possible:

50 foot span, 18 foot eave height: withstands 25 psf snow and 110 mph winds or 50 psf snow and 90 mph winds; or 60 foot span, 16 foot eave height: withstands 25 psf snow and 110 mph winds or 50 psf snow and 90 mph winds; or 70 foot span, 22 foot eave height: withstands 25 psf snow and 110 mph winds.

Depending on the application, (i.e., structural geometry, local conditions, building codes) not all structural enhancements shown in FIGS., 10, 11 may be required. The elements needed for building performance can be selected by use of computer software available from the metal building industry that performs load calculations, e.g., software listed at http://dmoz.org/Science/Technology/Software_for_Engineering/Civil_Engineering/Structural_Engineering or the RISA-3D software from Risa Technologies of Foothills Ranch, Calif. The resulting calculations will be reviewed and stamped by a professional engineer.

4. Extended Eaves

Figure 12:
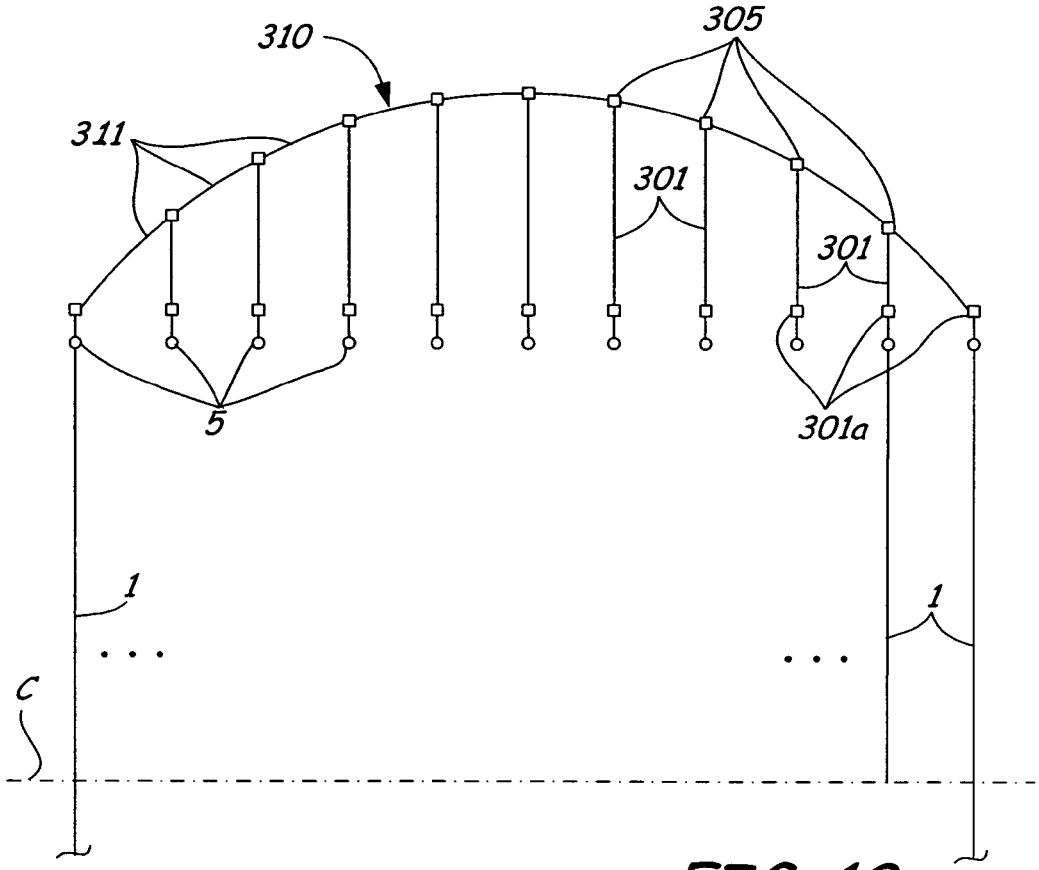
FIG. 12 is a partial plan view of a building using an embodiment of the invention showing an alternative extended wall structure.
Figure 13:
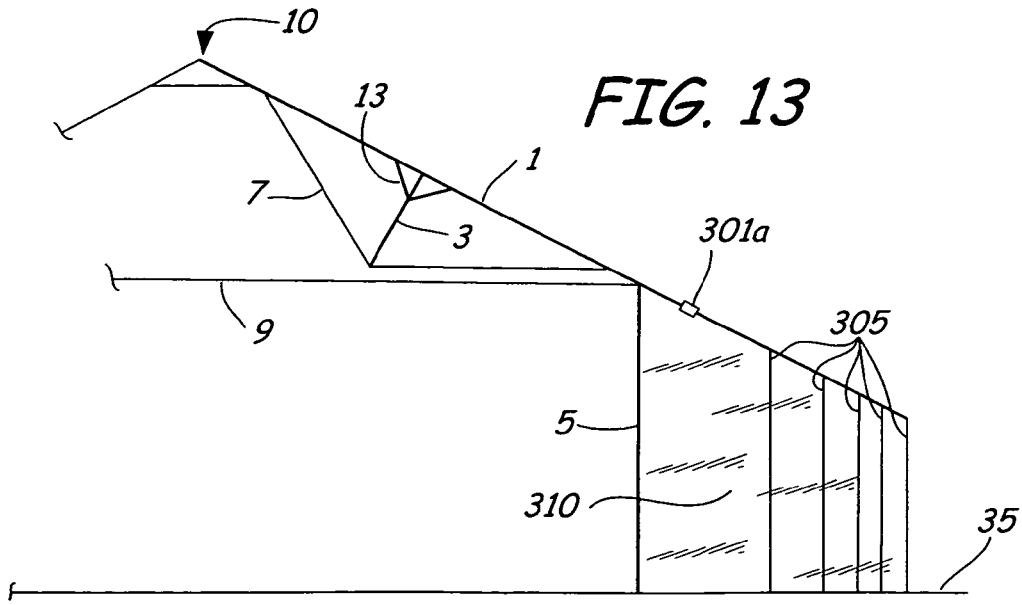
FIG. 13 is partial end view of a building using an embodiment of the invention showing an alternative extended wall structure as in FIG. 12.

FIGS. 12 and 13 show another building that is a variation on the basic structure described above and that may be advantageous in certain conditions. Here, the design is extended to provide for a lowered eave and a curved side wall. FIGS. 12, 13 each show one half of a symmetrical building made with trusses as seen in FIG. 1 or FIG. 11. It will be understood that the other half of the building is symmetrical.

Each truss has the same upper member 1, tensioning member 3 with supports 13 and tensioning cable 7 as in FIG. 1. The upper member 1 is joined to the opposed upper member 2 at peak connector 10. The upper members 1 of the trusses end at or near the connection point of the upper member 1 to a vertical member 5. Starting with the upper member 1 adjacent the upper member 1 that is at each end of the building, an eve extension member 301 is added at extension joint 301*a*, which may be a threaded connector. The length of each eave extension 301 increases as the extensions are added to upper members nearer the middle of the building and reaches a maximum at the middle of the building. Thus, the outer ends of the eve extensions 301 trace points on a curve extending between the vertical member 5 at each end of the building. Each consecutive eave extension 301 not only extends out further, until the maximum extension is reached at the middle of the building side, but extends a bit lower than the next, until the middle of the building is reached. That is, the overhang increases in both distance and descent below the top of the vertical members 5, such that the eave extension 301 traces a curve that descends to its center and rises toward each end. At the outer end of each eave extension, a secondary vertical member 305 is placed, with a foundation the same as for the vertical members 5, although the secondary vertical members 305 will not bear vertical loads as large as the vertical members 5. These secondary vertical members form the skeleton for a curved outer wall 310 formed from material attached to the secondary vertical members 305. For further stability at the curved outer wall 310, struts 311 may be connected between the upper ends of adjacent secondary vertical members 305.

Such a curved outer wall 310 helps deflect some horizontal wind forces and reduces the opportunity for uplift by lowering the point at which the wind might catch the eave and eliminating eave overhang.

D. Recycled Components

As noted above, in a preferred embodiment, the upper members, 1, 2, tensioning members 3, 4, vertical members 5, 6 and various foundation members may be made from discarded or surplus drill pipe. This material is of benefit because it is strong, relatively inexpensive and generally reliable. Drill pipe may be used in situations where it gets used conservatively, far from its expected fatigue limits, because an in-hole failure at great depths is so undesirable. Accordingly, it still has significant remaining strength and useful life. A person familiar with the material can usually make a good assessment of its quality with minimal inspection or testing. The same is true of any used cable that may be employed for any of the tensioning cables used in the present invention. As a result the present invention can facilitate significant reuse of materials that have additional useful life but might otherwise merely be discarded and become a disposal problem.

E. Construction Methods

A roof-wall truss system in accordance with FIG. 1 of the present invention is preferably assembled by laying out the upper members, 1, 2, tensioning members 3, 4, and vertical members 5, 6 on a flat, substantially horizontal surface and making the various weld joints or other connections to interconnect these members and to introduce the peak connector 10 and the support members 13. The tensioning cables 7, 8 that span the individual upper members 1, 2 are then introduced and preliminarily tensioned to the desired tension. The third tensioning cable 9 can then be introduced and preliminarily tensioned between either the two vertical members or between the lower ends of the two upper members 7, 8 (according to the embodiment selected). The tension here should not be so high as to stress the peak connector 10 by tending to fold together the legs of the large "V" formed by the entire truss system. At the same time, the tension must be sufficient to resist excessive opening of the large, inverted "V" that may occur when the individual upper members 1, 2 are lifted.

As noted above, the foundation for a building as described herein may be formed from pipe sections driven into the ground. Given the relatively common availability of 2⅞" O.D. pipe and 3" I.D. drilling pipe, and the fact that the smaller pipe fits relatively snugly into the interior of the larger pipe, simple foundation arrangements are possible. If the side wall vertical members are made of 2⅞" O.D. pipe, then a section of 3" I.D. pipe (about 2' in length) can be telescoped over a section of 2⅞" O.D. pipe (about 5' in length) and welded in place, to make a foundation element 12. About one foot of the length of the 3" I.D. pipe is not overlapped with the 2⅞" O.D. pipe, to leave a receiver section. This unit may be driven into the ground with the receiver section uppermost at the planned location for a vertical member. The side wall vertical member of 2⅞" O.D. pipe can be fitted inside the 3" I.D. pipe, which then functions as an external receiver. Welding can be used to secure the two inter-fitting pipe segments.

If the side walls are made of 3" I.D. pipe, then a section of 2⅞" O.D. pipe (about 2' in length) can be telescoped inside of the 3" I.D. pipe (about 5' in length) and welded in place, to make a foundation elements 12. This unit may be driven into the ground at the planned location for a vertical member. About one foot of the length of the 2⅞" O.D. pipe is not overlapped with the 3" I.D. pipe, to leave a receiver section. The sidewall section of 3" I.D. pipe can be fitted over the outside of the 2⅞" O.D. pipe, which functions as an internal receiver.

This type of foundation permits a building to be built using the disclosed truss in rugged terrain. The builder can roughly clear and level a construction site for construction of one of the buildings. No concrete slab need be poured, although that may be desired in some applications. The preferred scenario would be to drive equal lengths of pipe (welded into the foundation elements as described above) into the ground an equal distance, so that all the receivers would be at the same elevation. If, however, in driving the foundation elements, the builder finds some of them encounter solid rock or some other obstruction that prevents them from being driven to a given, desired level (but further assuming that they have been driven far enough to be secure), the problem can be solved by simply trimming the side wall vertical member pipe by the appropriate length. This will keep all the side walls the same height. A transit could easily determine the amount to be cut off of each side wall member. Thus, the roof-wall truss and building design described herein enables use of quick and easy and inexpensive foundations. Even if the foundation elements are set in concrete rather than being driven into the ground, construction of the foundation is relatively simple. Tubular cardboard concrete forms can be placed in small foundation point excavations, with the foundation elements described above placed in the forms and surrounded with concrete.

It should further be noted that the roof-wall trusses as described herein can be constructed on-site under relatively rugged conditions, because a completely regular and flat work surface is not necessary. As shown in FIG. 8, if work station strips 90, 91, 92 of equal elevation (as determined by a transit) can be established for the walls, i.e., for the junction points of the upper members 1, 2 and the vertical member 5, 6 (or 65, 66, 75, 76 per FIGS. 6, 7) and for the location at which upper members are joined to form truss peak 10 (walls only for the embodiments of FIGS. 6, 7), then construction in the field can proceed. A roof-wall truss as in FIG. 1 (or FIG. 6, 7 or 12, as well) can be assembled close to the foundation elements in which it will be received. Once assembled, the truss can be rotated up into vertical position and seated in or on foundation elements 12. The assembly process can begin at one end of the work station strips 90, 91, 92 and progress through a series of parallel, spaced, adjacent roof-wall trusses. (For simplicity, FIG. 8 shows a first erected truss 100 at one end of the building structure and a next-in-process truss 101, with its erected position shown partially in phantom.) The ability of the various pipe members to flex and thus be adjusted means that some minor inaccuracies in dimensions or construction of individual trusses can be overcome when the trusses are raised into final position.

Once a complete roof-wall truss system in accordance with FIG. 1 is fully assembled with preliminary tensioning, it can be lifted and rotated into position between two opposed foundation elements selected to mate with the lower ends of vertical members 5, 6 and placed with a separation that matches the at-rest separation of the truss system when assembled flat. In the case of larger trusses not manageable by hand, lifting can be accomplished by attaching a pair of crane cables to a pair of lifting loops welded to the first and second upper members 1, 2. These lifting loops or other suitable connection means for the crane cables may be located near the center of each upper member 1, 2. It will be recognized that as the truss system is rotated from a horizontal plane into a vertical plane, the legs of the large "V" formed by the entire truss will tend to spread. The preliminary tensioning of the cable 9 is selected to resist this spreading tendency. Once the vertical members 5, 6 are in their respective foundation elements, the lifting crane cable pair can be released, and the spreading stress caused by lifting will no longer be present.

When each full truss system is in place, final tensioning of the tensioning cables for upper members 1, 2 and between vertical members 5, 6 (or, in another embodiment, between the lower ends of upper members 1, 2) can take place. Depending on the span of the truss system and the expected snow, wind or other loads, the desired tensions can be adjusted in accordance with structural engineering calculations. Additional between-truss bracing or cabling as shown in FIGS. 12, 13 may be added as needed to increase strength and meet local conditions or codes. If desired, the adjustable components, such as turnbuckles, can be welded or otherwise fixed so that they can no longer be adjusted or come out of adjustment. Alternatively, they can be left adjustable should settling, stretching or deforming of any members or changes in conditions make any further adjustment desirable. If left adjustable, these adjustable elements may be covered with wall or ceiling panels or other housings or enclosures, so that tampering is not a temptation.

Once a building frame or structure in accordance with the present invention has been erected, the building can be completed with a variety of wall and roof panels, including plywood sheets or various kinds of metal sheets. Insulation sheets can be added or layers of insulation can be part of the roof and wall panels when erected.

F. Conclusion

While several embodiments of the invention have been illustrated and described, it will be apparent to those skilled in the art that various changes and modifications may be made therein without departing from the spirit of the invention or from the scope of the appended claims. Furthermore, though the embodiments have only been shown in a roof truss or roof-wall truss context, it will be apparent to those skilled in the art that the disclosed truss system could also be applied to other situations requiring structural support.

What is claimed is:

1. A truss comprising:

a first upper longitudinal member with first and second ends and a second upper longitudinal member with first and second ends, wherein the first end of the first upper longitudinal member and the first end of the second upper longitudinal member are joined at an angle, forming a truss peak junction;

a first tensioning member wherein one end of said first tensioning member is perpendicularly secured to the first upper longitudinal member at a first junction located between the first upper longitudinal member's first and second ends, from which the first tensioning member extends to a distal end;

a second tensioning member wherein one end of said second tensioning member is perpendicularly secured to the second upper longitudinal member at a second junction located between the second upper longitudinal member's first and second ends, from which the second tensioning member extends to a distal end;

a first vertical member with a top end rigidly secured to the first upper longitudinal member at a third junction located on said first upper longitudinal member between the second end of said first upper longitudinal member and the first junction;

a second vertical member with a top end rigidly secured to the second upper longitudinal member at a fourth junction located on said second upper longitudinal member between the second end of said second upper longitudinal member and the second junction;

a first cable with first and second ends, wherein said first cable's first end is secured to the first upper member near the truss peak junction, said first cable is routed to and from a point near the distal end of the first tensioning member, and said first cable's second end is secured to the first upper longitudinal member near the third junction, to carry tension applied between the first cable's first and second ends;

a second cable with first and second ends, wherein said second cable's first end is secured to the second upper member near the truss peak junction, said second cable is routed to and from a point near the distal end of the second tensioning member, and said second cable's second end is secured to the second upper longitudinal member near the fourth junction, to carry tension applied between the second cable's first and second ends; and a third cable with first and second ends having its first and second ends secured so as to apply tension that opposes spreading of the locations of the third and fourth junctions.

2. The truss as recited in claim 1 wherein the longitudinal members are made out of pipe.

3. The truss as recited in claim 2 wherein the pipe is used drill pipe.

4. The truss as recited in claim 2 further comprising foundation elements made from pipe sized to receive internally or externally pipe of a lower end of the first and second vertical members.

5. The truss as recited in claim 1 wherein the truss peak junction is formed with an angle-adjustable connector.

6. The truss as recited in claim 1 wherein the truss peak junction is formed with at least one gusset plate rigidly connected between the first and second upper longitudinal members.

7. The truss as recited in claim 1 combined with one or more substantially similar trusses, all said trusses being erected in parallel at spaced intervals to form a building structure.

8. The truss as recited in claim 1 further comprising a center post connected at the truss peak junction.

9. The truss as recited in claim 1 wherein the first and second cables are tensioned to preload their associated upper longitudinal members.

10. The truss as recited in claim 1 wherein the third cable is connected to and extends between the first and second vertical members.

11. A method of constructing a pipe and cable truss system for a structure comprising:

providing a first and a second upper longitudinal member, each with an upper and a lower end;

securing the upper end of a first upper longitudinal member at an angle to the upper end of the second upper longitudinal member, thereby forming a truss peak junction;

perpendicularly securing one end of a first tensioning member to the first upper longitudinal member at a first junction located between the first upper longitudinal member's upper and lower ends;

perpendicularly securing one end of a second tensioning member to the second upper longitudinal member at a second junction located between the second upper longitudinal member's upper and lower ends;

rigidly securing a top end of a first vertical member to the first upper longitudinal member at a third junction located on said first upper longitudinal member between the lower end of said first upper longitudinal member and the first junction;

rigidly securing a top end of a second vertical member to the second upper longitudinal member at a fourth junction located on said second upper longitudinal member between the lower end of said second upper longitudinal member and the second junction;

securing a first end of a first cable to the first upper longitudinal member near the truss peak junction, routing said cable to and from a distal end of the first tensioning member, and securing said cable's other end to the first upper longitudinal member near the third junction;

securing a first end of a second cable to the second upper longitudinal member near the truss peak junction, routing said cable to and from a distal end of the second tensioning member, and securing said cable's other end to the second upper longitudinal member near the fourth junction; and securing first and second ends of a third cable to points adjacent, respectively, the third and fourth junctions so as to apply tension that opposes spreading of the locations of the third and fourth junctions.

12. The method of constructing a pipe and cable truss system for a structure as recited in claim 11, wherein the step of providing first and second upper longitudinal members comprises providing pipe for such longitudinal members.

13. The method of constructing a pipe and cable truss system for a structure as recited in claim 11, wherein the step of providing first and second upper longitudinal members comprises providing used drill pipe for such longitudinal members.

14. The method of constructing a pipe and cable truss system for a structure as recited in claim 11, further comprising, after the elements of the truss are secured together on the ground, erecting the truss between opposed foundation elements in one piece.

15. The method of constructing a pipe and cable truss system for a structure as recited in claim 11, further comprising constructing a building frame with two or more such pipe and cable truss systems erected in parallel at spaced intervals.

16. The method of constructing a pipe and cable truss system for a structure as recited in claim 11, further comprising providing an eave extension member extending downwardly from the end of at least one upper longitudinal member to lower the outer eave line.

17. The method of constructing a pipe and cable truss system for a structure as recited in claim 16, wherein the step of providing an eave extension comprises, in a building erected from a plurality of said truss systems, selecting a length for the eave extension member such that the outer ends of a plurality of such eave extension members define a curve extending between the ends of the building, said curve descending to a lowest point at its center.

18. A building frame comprising:

three or more roof-wall trusses erected in parallel to define a rectangular building footprint, each truss comprising:

a first upper longitudinal member with first and second ends and a second upper longitudinal member with first and second ends, wherein the first end of the first upper longitudinal member and the first end of the second upper longitudinal member are joined at an angle, forming a truss peak junction;

a first tensioning member wherein one end of said first tensioning member is perpendicularly secured to the first upper longitudinal member at a first junction located between the first upper longitudinal member's first and second ends, from which the first tensioning member extends to a distal end;

a second tensioning member wherein one end of said second tensioning member is perpendicularly secured to the second upper longitudinal member at a second junction located between the second upper longitudinal member's first and second ends, from which the second tensioning member extends to a distal end;

a first vertical member with a top end rigidly secured to the first upper longitudinal member at a third junction located on said first upper longitudinal member between the second end of said first upper longitudinal member and the first junction;

a second vertical member with a top end rigidly secured to the second upper longitudinal member at a fourth junction located on said second upper longitudinal member between the second end of said second upper longitudinal member and the second junction;

a first cable with first and second ends, wherein said first cable's first end is secured to the first upper member near the truss peak junction, said first cable is routed to and from a point near the distal end of the first tensioning member, and said first cable's second end is secured to the first upper longitudinal member near the third junction;

a second cable with first and second ends, wherein said second cable's first end is secured to the second upper member near the truss peak junction, said second cable is routed to and from a point near the distal end of the second tensioning member, and said second cable's second end is secured to the second upper longitudinal member near the fourth junction; and a third cable with first and second ends having its first and second ends secured so as to apply tension that opposes spreading of the locations of the third and fourth junctions; and structural enhancements comprising one of more of the following:

rigid knee bracing spanning the third and fourth junctions of each of two or more trusses; or rigid bracing spanning the truss peak junctions of each of two or more adjacent trusses; or crisscrossing cable bracing between an adjacent pair of first vertical members in an adjacent pair of trusses; or crisscrossing cable bracing between an adjacent pair of first longitudinal members in an adjacent pair of trusses and between the corresponding pair of second longitudinal members of that adjacent pair of trusses; or rigid ridge bracing between an adjacent pair of trusses, said bracing located at or adjacent the truss peak junctions of the adjacent pair of trusses; or rigid eave bracing between adjacent pairs of trusses, said bracing located at or adjacent the top ends of first and second vertical members of such adjacent pairs of trusses.

19. The building frame of claim 18 wherein the building frame comprises four or more roof wall trusses and the structural enhancements are implemented in the first pair of adjacent trusses at each end of the building structure.

20. The building frame of claim 18 wherein the building frame comprises six or more roof wall trusses and the structural enhancements are implemented in the first pair and the second pair of adjacent trusses at each end of the building structure.

21. The building frame of claim 18 wherein the building frame comprises six or more roof wall trusses and each of the structural enhancements enumerated are used and are implemented in the first pair and the second pair of adjacent trusses at each end of the building structure.

22. The building frame of claim 18 wherein the building frame comprises six or more roof wall trusses and a selection of the structural enhancements enumerated are used and are inserted in pairs of adjacent trusses at each end of the building structure, said pairs being selected to be symmetrical between the ends of the building and said selection of structural enhancements being sufficient to meet local wind and snow load building codes for the resulting building.

* * * * *